US008539942B2

(12) United States Patent
Walsh et al.

(10) Patent No.: US 8,539,942 B2
(45) Date of Patent: Sep. 24, 2013

(54) STOVE

(76) Inventors: Dermot Walsh, Waterford (IE); Michael Holton, Carrigeen (IE)

( * ) Notice: Subject to any disclaimer, the term of this patent is extended or adjusted under 35 U.S.C. 154(b) by 249 days.

(21) Appl. No.: 12/594,016

(22) PCT Filed: Mar. 31, 2008

(86) PCT No.: PCT/EP2008/053850
§ 371 (c)(1),
(2), (4) Date: Jan. 6, 2010

(87) PCT Pub. No.: WO2008/119796
PCT Pub. Date: Oct. 9, 2008

(65) Prior Publication Data

US 2010/0108051 A1 May 6, 2010

(30) Foreign Application Priority Data

Mar. 30, 2007 (IE) ..... S2007/0227

(51) Int. Cl.
*F24C 3/08* (2006.01)

(52) U.S. Cl.
USPC ..... 126/52; 126/39 E; 431/88

(58) Field of Classification Search
USPC ..... 126/52, 39 E, 234, 238; 431/88; 137/38, 65, 75
See application file for complete search history.

(56) References Cited

U.S. PATENT DOCUMENTS

| | | | | |
|---|---|---|---|---|
| 3,994,359 | A * | 11/1976 | Smitley | 180/282 |
| 4,380,428 | A | 4/1983 | Rozzi | |
| RE38,220 | E | 8/2003 | Engdahl | |

FOREIGN PATENT DOCUMENTS

| | | |
|---|---|---|
| EP | 1348910 A1 | 10/2003 |
| GB | 944981 | 12/1963 |
| WO | 03/083368 | 10/2003 |

OTHER PUBLICATIONS

International Search Report, dated Mar. 26, 2009, received in international patent application No. PCT/EP2008/053850, 2 pgs.
Written Opinion of the International Searching Authority mailed Mar. 26, 2009 received in PCT/EP2008/053850 (4 pgs.).
International Preliminary Report on Patentability Authority issued Oct. 6, 2009 received in PCT/EP2008/053850 (5 pgs.).

* cited by examiner

*Primary Examiner* — Alfred Basichas
(74) *Attorney, Agent, or Firm* — Brian Colandreo; Jeffrey T. Placker; Holland & Knight LLP

(57) ABSTRACT

The stove has a fuel reservoir formed by a cylindrical canister. A stop valve is mounted at a top of the canister for regulating supply of fuel gas from the canister through a fuel passage to a burner head mounted on top of the stop valve. The fuel passage has an inlet in the canister and an outlet at the burner head and extends through the stop valve which is mounted in the fuel passage. The stop valve is a rotary valve controlled by a hand wheel which can be rotated by a user to move the stop valve between open and closed positions. An emergency shut-off valve is mounted at the inlet to the fuel passage and is operable when the stove is knocked over.

16 Claims, 5 Drawing Sheets

STOVE

RELATED APPLICATIONS

The subject application is a U.S. National Stage application that claims the priority of International Application No. PCT/EP2008/053850, filed on 31 Mar. 2008, which claims the priority of Irish National Application No.: S2007/0227, filed on 30 Mar. 2007, the contents of which are herein incorporated by reference in their entirety.

BACKGROUND OF THE INVENTION

The invention relates to stoves, and in particular chafing burners and the like.

The invention is particularly concerned with compact portable freestanding stoves of the type previously described in EP-A-1348910, which essentially comprise a burner and an associated fuel reservoir, a fuel passage communicating between the fuel reservoir and the burner and a stop valve to control the supply of fuel from the reservoir to the burner.

Various types of chafing burner are used in the catering industry to keep pre-cooked food hot over a period of time before the food is served. Some of these either burn a fuel directly from a small container or burn the fuel via a wick. A problem with known chafing burners is that persons handling the burners are easily burnt and the chafing burners are a serious fire hazard as they are easily knocked over during use.

The present invention is directed towards overcoming these problems.

SUMMARY OF THE INVENTION

According to the invention, there is provided a stove, including:

a burner, a fuel reservoir, a fuel passage communicating between the fuel reservoir and the burner, a stop valve in the fuel passage which is operable to control the supply of fuel from the reservoir to the burner, characterised in that there is provided a normally open emergency shut-off valve which is operable to close the fuel passage when the stove is tipped away from a normal upstanding operating position by a preset amount.

Thus advantageously, if the stove is knocked over, the emergency shut-off valve closes, gas supply to the burner is cut off and the flame extinguished.

In one embodiment of the invention, means is provided for resetting the emergency shut-off valve to the normally open position, after closure of the emergency shut-off valve.

In a preferred embodiment, the resetting means is operably connected to the stop valve such that the stop valve must be closed to reset the emergency shut-off valve.

In another embodiment, the emergency shut-off valve comprises a valve chamber having an inlet for communicating with the fuel reservoir and an outlet for communication with the fuel passage to the burner, a valve seat at the outlet, a valve member movable through the valve chamber between a disengaged open position and an engaged closed position in sealing engagement with the valve seat.

In another embodiment, the valve member is movable through the valve chamber into the engaged position by gravity.

In another embodiment, the valve member is a ball.

In an alternative arrangement, the valve member is a plunger.

In another embodiment the emergency shut-off valve is engagable with an inlet of the fuel passage and a pin on the stop valve is engagable through the inlet of the fuel passage when the stop valve is in the closed position to disengage the emergency shut-off valve from the inlet to reset the emergency shut-off valve into an open position.

In another embodiment the fuel reservoir is a container having a stop valve receiving opening in a top wall of the container and a filling valve receiving opening in a bottom wall of the container, said openings being in alignment, the stop valve being mounted in said top wall opening and the filling valve being mounted in said bottom wall opening, said stop valve and said filling valve interengaging within the container to secure the valves on the container.

In another embodiment inner ends of the stop valve and the filling valve are screwed together within the container to secure the valves on the container.

In another embodiment the fuel reservoir is a container of two-part construction comprising a base part and a top part which sits on and is welded to the base part, said base part having a bottom wall with an upstanding side wall, said top part having a top wall with a downwardly depending peripheral skirt which overlaps and is secured to a top of the side wall, an out-turned annular flange at a bottom of the skirt forming a hand grip, or container support.

In another embodiment the stop valve is a rotary valve controlled by a hand wheel located above a top of a container forming the fuel reservoir and rotatable about a vertical axis for moving the stop valve between an open and a closed position.

In another embodiment at least one stop projection extends upwardly from the top of the container, a complementary downwardly projecting lug on the hand wheel being engagable with said at least one stop projection to define stop valve open and closed position.

In another embodiment at least one stop projection is integrally formed with a top wall of the container.

In another embodiment the hand wheel has a number of spaced-apart guard posts which project upwardly from the hand wheel, said guard posts being arranged about the burner.

In another embodiment a deflector plate is mounted between the guard posts spaced above the hand wheel.

In another embodiment a burner head is mounted in a central slot on the deflector plate.

In another embodiment a gap is provided between a bottom of the burner head and a top of the stop valve.

BRIEF DESCRIPTION OF THE DRAWINGS

The invention will be more clearly understood by the following description of some embodiments thereof, given by way of example only, with reference to the accompanying drawings, in which.

DETAILED DESCRIPTION OF PREFERRED EMBODIMENTS

Figure 2:
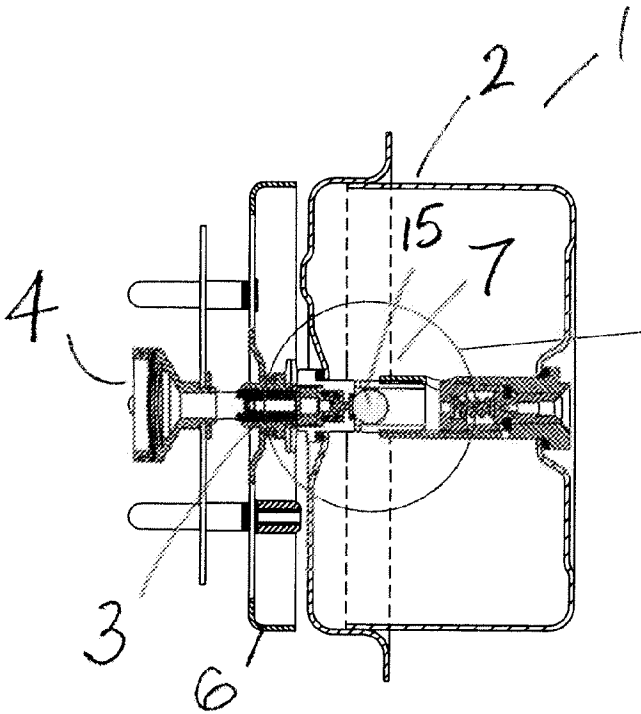
FIG. 2 is a sectional elevational view of the stove, shown toppled over on its side.

Referring to the drawings, there is illustrated a stove according to the invention, indicated generally by the reference numeral 1. The stove 1 has a fuel reservoir formed by a cylindrical canister 2. A stop valve 3 is mounted at a top of the canister 2 for regulating supply of fuel gas from the canister 2 through a fuel passage to a burner head 4 mounted above on top of the stop valve 3. The fuel passage has an inlet 5 in the canister 2 and an outlet at the burner head 4 and extends through the stop valve 3 which is mounted in the fuel passage. The stop valve 3 is a rotary valve controlled by a hand wheel 6 which can be rotated by a user to move the stop valve 3 between open and closed positions. An emergency shut-off valve 7 is mounted at the inlet 5 to the fuel passage and is operable when the stove 1 is knocked over, as shown in FIG. 2, to close the fuel passage.

The emergency shut-off valve 7 comprises a cylindrical valve chamber 10. Radial inlet ports 11 in a side wall 12 of the valve chamber 10 communicate with the fuel reservoir within the canister 2. An outlet of the valve chamber 10 is formed by the inlet 5 to the fuel passage which leads to the stop valve 3 and has a nitrile O-ring seal 14. A stainless steel ball 15 forming an emergency shut-off valve is movable through the valve chamber 10. When the stove 1 is tipped over, as shown in FIG. 2, the ball 15 rolls along the valve chamber 10 and sealingly engages the O-ring seal 14 to stop gas supply from the canister 2 to the burner head 4 and thus extinguish the burner flame.

Figure 4:
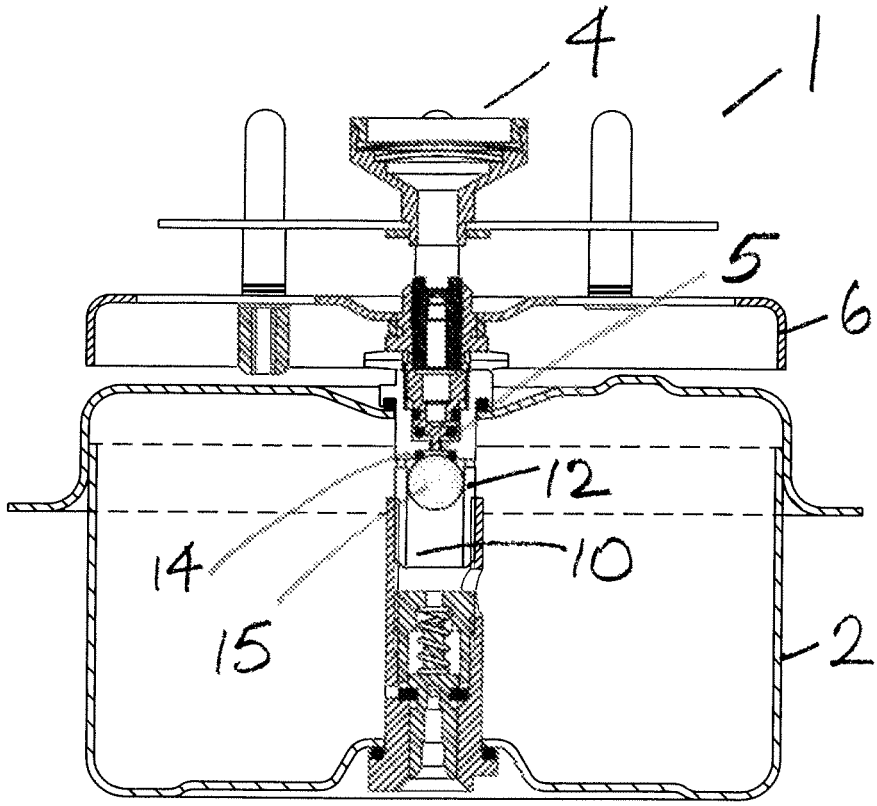
FIG. 4 is a sectional elevational view of the stove, showing the emergency shut-off valve in a closed position.

The difference in pressure between the interior and exterior of the canister 2 is such that the ball 15 is held in place against the O-ring seal 14 when the stove 1 is again returned to an upright position, as shown in FIG. 4.

Figure 6:
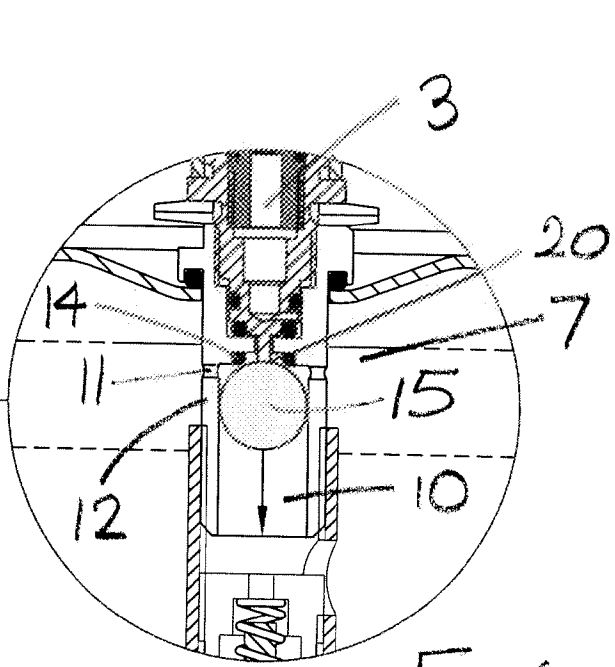
FIG. 6 is an enlarged detail sectional view showing resetting of the emergency shut-off valve.
Figure 5:
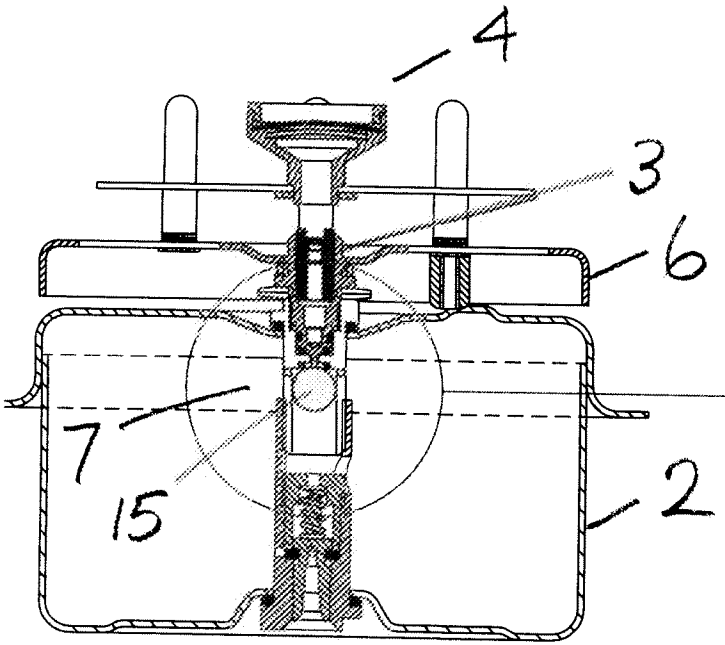
FIG. 5 is a sectional elevational view of the stove, showing resetting of the emergency shut-off valve.
Figure 7:
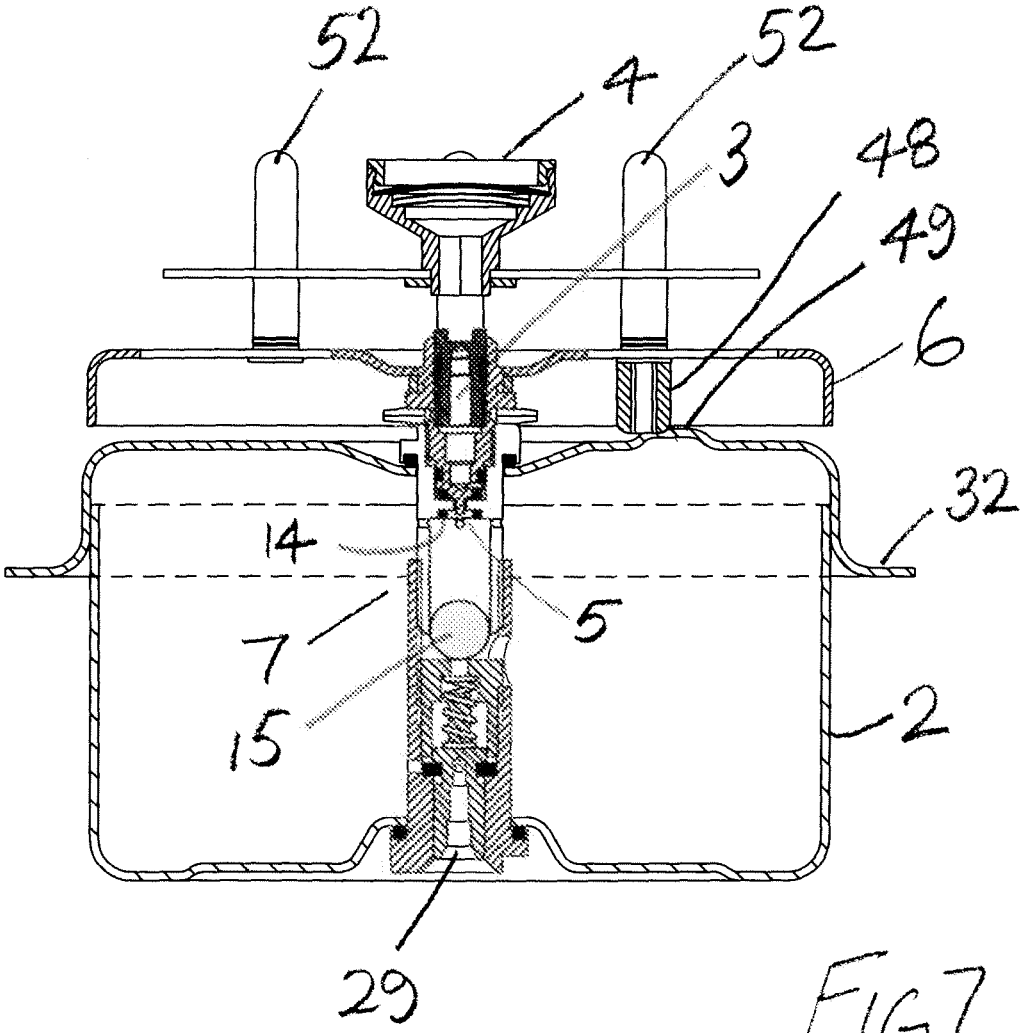
FIG. 7 is a sectional elevational view of the stove showing the emergency shut-off valve in the reset position.

To reset the emergency shut-off valve 7, the hand wheel 6 must be fully turned to the off position. In the off position (as shown in FIGS. 5 and 6), a pin 20 on the stop valve 3 projects through the inlet 5 and O-ring seal 14, pushing the ball 15 out of engagement with the O-ring seal 14, the ball 15 dropping to the bottom of the valve chamber 10 when disengaged. FIG. 7 shows the ball 15 in the disengaged position and the stop valve 3 in the closed position. The stop valve 3 can then be re-opened, as required, and the burner 4 operated as normal.

The canister 2 is of two-part construction comprising a thin-walled metal container having a base part 25 and a top part 26 which sits on and is welded to the base part 25. The base part 25 has a bottom wall 27 and an upstanding cylindrical side wall 28 extending around the bottom wall. A filling valve 29 is centrally mounted on the bottom wall 27. The top part 26 has a top wall 30 with a downwardly depending peripheral skirt 31 which overlaps and is secured to a top of the side wall 28. An out-turned annular flange 32 at a bottom of the skirt 31 forms a convenient handgrip for lifting the stove 1. The flange 32 also conveniently allows the canister 2 to be dropped onto a support having a through-hole sized to receive the canister 2 with the flange 32 resting on top of the support.

The canister 2 contains a pressurised liquid gas fuel such as propane or butane. Preferably a 10%/90% propane/butane mix is provided. This fuel provides a clearly visible flame so users can easily tell whether or not it is in operation.

A valve body 40 of the stop valve 3 is centrally mounted in the top wall 30. A valve member 42 screws up and down within the valve body 40 to open and close the stop valve 3.

The hand wheel 6 has a circular top 46 with a downwardly depending peripheral flange 47 which forms a handgrip. To this end, the peripheral flange 47 may be roughened or undulated to improve grip. A lug 48 projects downwardly from the top 46 and is engagable with an associated stop projection 49 which is integrally formed with and projects upwardly on the top wall 30 of the canister 2, opposite sides of the projection 49 being engagable by the lug 48 when the valve 3 is either fully open or fully closed.

Three spaced-apart guard posts 52 project upwardly from the top 46 of the hand wheel 6 on which they are mounted. These posts 52 provide protection for the burner head 4. The guard posts 52 extend above the burner head 4, typically by about 15 mm.

A circular deflector plate 55 is mounted on the guard posts 52. This will shield lower parts of the stove 1 from heat generated at the burner 4 and also reflect heat upwardly towards any dishes mounted on the posts 52. The burner head 4 is mounted in a central slot 57 in the deflector plate 55 and is retained in engagement therewith by a circlip 58 which engages an underside of the deflector plate 55 and an associated circumferential slot in a tubular body 59 of the burner head 4. Thus, the burner head 4 can be readily easily changed if required.

It will be noted that there is a gap 65 between a bottom of the burner head 4 and a top of the stop valve 3. This prevents heat from the burner head 4 being conducted downwardly to the stop valve 3 and canister 2.

An outlet jet 68 at a top of the stop valve 3 directs fuel gas through the burner head 4. An inner diffuser mesh 69 and an outer catalyst mesh 70 are mounted in the burner head 4. Once the catalyst mesh 70 heats up it will automatically re-ignite the fuel gas if the flame at the burner head 4 is accidentally blown out by a draft of wind, for example, during use.

Figure 1:
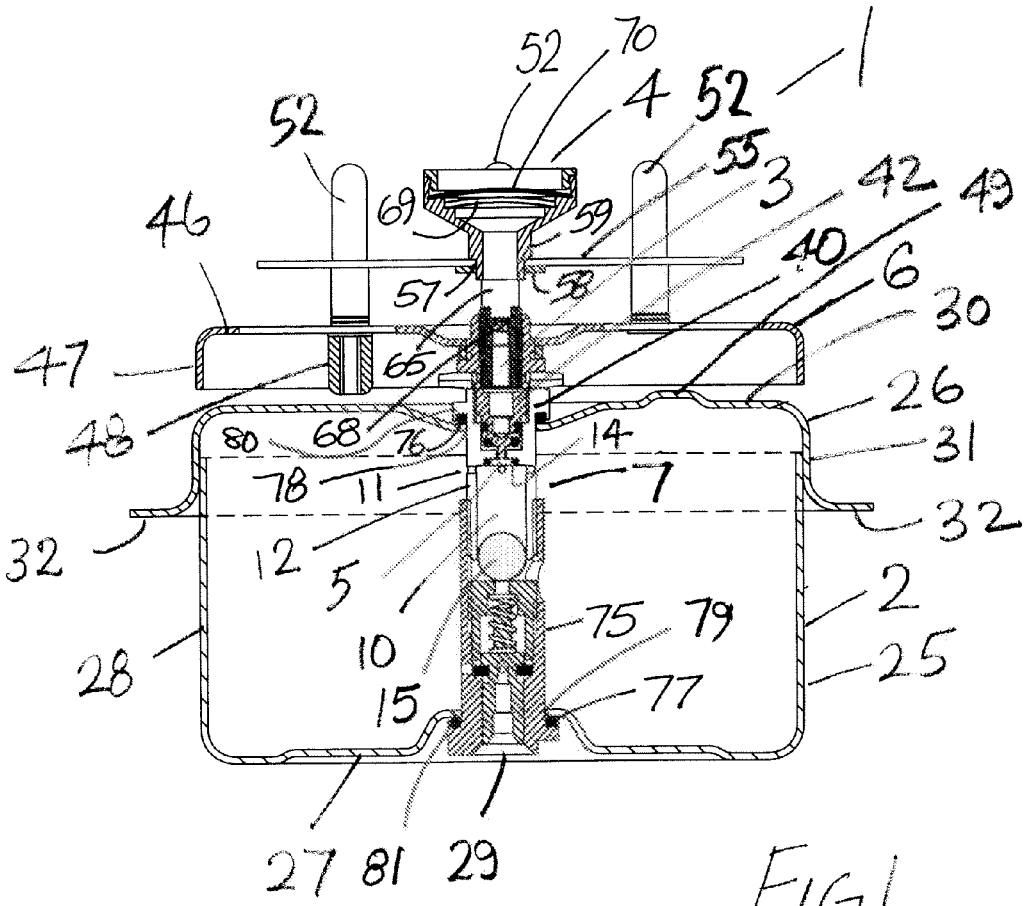
FIG. 1 is a sectional elevational view of a stove according to the invention.
Figure 3:
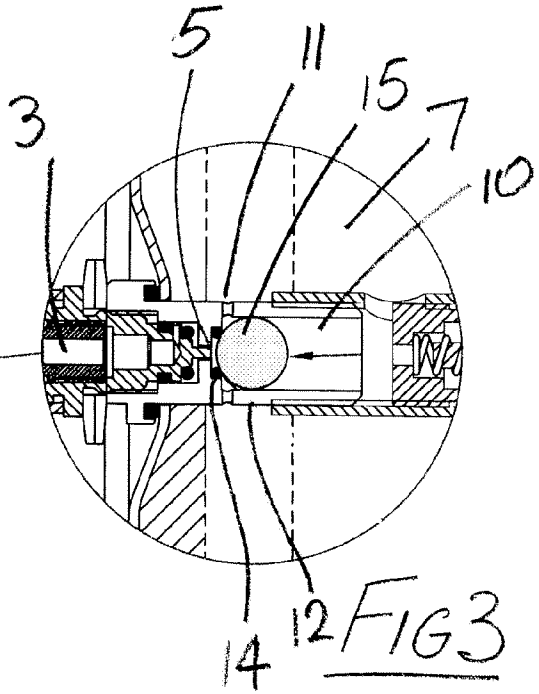
FIG. 3 is an enlarged detail sectional view showing an emergency shut-off valve forming portion of the stove.

The valve body 40 of the stop valve 3 assembly and the valve body 75 of the filling valve 29 screw together within the canister 2. A bottom of the valve body 40 screws into a top of the valve body 75 as shown in FIG. 1. Suitable seals 76, 77 are provided at central mounting openings 78,79 in the top wall 30 and bottom wall 27 of the canister 2 through which the valve bodies 40, 75 pass. Annular projections 80,81 on each valve body 40,75 engage against an outer periphery of each mounting opening 78,79. This is a convenient construction as it means that it is not necessary to provide separate mounts at a top and bottom of the canister for mounting the stop valve 3 and filling valve 29.

In use, with the stop valve 3 in the open position, fuel gas passes through the fuel passage from the canister 2 to the burner head 4 where it is ignited. A plate or pot of food is mounted on a stand above the burner head 4 where it is heated by the flame. Should the stove 1 be accidentally knocked over, the emergency shut-off valve 7 operates, as previously described, cutting off the fuel supply to the burner head 4 to extinguish the flame. By closing the stop valve 3, using the hand wheel 6, the emergency shut-off valve 7 can be reset and the stove 1 restarted and used in the usual way.

It will be appreciated that the invention provides a compact stove for use as a chafing burner which is efficient in operation. While use of the stove as a chafing burner has been described herein, the stove could also be used in other pursuits requiring a compact stove, such as mountaineering, camping and the like.

The stove may be manufactured from any suitable materials of construction, for example, stainless steel.

It will be appreciated that should the stove be knocked over, it automatically cuts off the flow of gas to the burner head which extinguishes its flame. This eliminates the chance of a fire breaking out. Also, the fact that gas flow is stopped, prevents the build-up of gas which could also be a fire hazard if someone tried to relight the burner.

When the safety shut-off valve has been activated, the burner must be reset before it can be used again, which eliminates the possibility of the burner being relit accidentally. Due to the nature of the burner and its applications, i.e. buffet counters, cruise ships, busy kitchens, hotels and the like, there is always the possibility that the burner may be accidentally knocked over and it is essential that it is not a safety hazard.

It will be noted that the reset pin on the stop valve 3 for resetting the emergency shut-off valve 7 could be omitted. A ball 15 will after a period of time drop under its own weight when the burner has been switched off fully. By varying the material used in the ball 15 (changing its weight), the time delay before the ball drops can be controlled. The ball 15 could also be replaced by a plunger which would slide up and down freely inside the valve system. The shut-off o-ring seal 14 can also be removed and replaced by a high quality surface finish at the end of the valve system which would create a seal with the ball 15.

The invention is not limited to the embodiments hereinbefore described which may be varied in both construction and detail within the scope of the appended claims.

The invention claimed is:

1. A stove, including:

a burner, a fuel reservoir for storing a fuel gas, a fuel passage communicating between the fuel reservoir and the burner, a stop valve in the fuel passage which is operable to control the supply of fuel gas from the fuel reservoir to the burner, a normally open emergency shut-off valve mounted at the fuel passage, said emergency shut-off valve being operable to close the fuel passage to stop fuel gas flow through said fuel passage when the stove is tipped away from a normal upstanding operating position by a preset amount, wherein the emergency shut-off valve comprises a valve chamber having an inlet for communicating with the fuel reservoir and an outlet for communication with the fuel passage to the burner, a valve seat at the outlet, a valve member movable through the valve chamber between a disengaged open position and an engaged closed position in sealing engagement with the valve seat, and wherein the emergency shut-off valve is engagable with an inlet of the fuel passage and a pin on the stop valve is engagable through the inlet of the fuel passage when the stop valve is in the closed position to disengage the emergency shut-off valve from the inlet to reset the emergency shut-off valve into an open position.

2. A stove as claimed in claim 1, further comprising means for resetting the emergency shut-off valve to the normally open position, after closure of the emergency shut-off valve.

3. A stove as claimed in claim 2, wherein the resetting means is operably connected to the stop valve, such that the stop valve must be closed to reset the emergency shut-off valve.

4. A stove as claimed in claim 1, wherein the valve member is movable through the valve chamber into the engaged position by gravity.

5. A stove as claimed in claim 1 wherein the valve member is a ball.

6. A stove as claimed in claim 1 wherein the valve member is a plunger.

7. A stove as claimed in claim 1 wherein the fuel reservoir is a container having a stop valve receiving opening in a top wall of the container and a filling valve receiving opening in a bottom wall of the container, said openings being in alignment, the stop valve being mounted in said top wall opening and the filling valve being mounted in said bottom wall opening, said stop valve and said filling valve interengaging within the container to secure the valves on the container.

8. A stove as claimed in claim 7 wherein inner ends of the stop valve and the filling valve are screwed together within the container to secure the valves on the container.

9. A stove as claimed in claim 1 wherein the fuel reservoir is a container of two-part construction comprising a base part and a top part which sits on and is welded to the base part, said base part having a bottom wall with an upstanding side wall, said top part having a top wall with a downwardly depending peripheral skirt which overlaps and is secured to a top of the side wall, an out-turned annular flange at a bottom of the skirt forming a hand grip, or container support.

10. A stove as claimed in claim 1 wherein the stop valve is a rotary valve controlled by a hand wheel located above a top of a container forming the fuel reservoir and rotatable about a vertical axis for moving the stop valve between an open and a closed position.

11. A stove as claimed in claim 10 wherein at least one stop projection extends upwardly from the top of the container, a complementary downwardly projecting lug on the hand wheel being engagable with said at least one stop projection to define stop valve open and closed position.

12. A stove as claimed in claim 11 wherein said at least one stop projection is integrally formed with a top wall of the container.

13. A stove as claimed in claim 10 wherein the hand wheel has a number of spaced-apart guard posts which project upwardly from the hand wheel, said guard posts being arranged about the burner.

14. A stove as claimed in claim 13 wherein a deflector plate is mounted between the guard posts spaced above the hand wheel.

15. A stove as claimed in claim 14 wherein a burner head is mounted in a central slot on the deflector plate.

16. A stove as claimed in claim 15 wherein a gap is provided between a bottom of the burner head and a top of the stop valve.

* * * * *